US006872149B1

(12) United States Patent
Devon

(10) Patent No.: US 6,872,149 B1
(45) Date of Patent: Mar. 29, 2005

(54) GOLF CLUB ALIGNMENT AID

(75) Inventor: Scott Devon, Ada, MI (US)

(73) Assignee: Catamount, Golf, LLC, Grand Rapids, MI (US)

( * ) Notice: Subject to any disclaimer, the term of this patent is extended or adjusted under 35 U.S.C. 154(b) by 0 days.

(21) Appl. No.: 10/361,340

(22) Filed: Feb. 10, 2003

(51) Int. Cl.[7] ..... A63B 69/36
(52) U.S. Cl. ..... 473/231; 473/244; 473/238
(58) Field of Search ..... 473/219, 223, 473/226, 237, 227, 231, 238, 242, 244, 257, 261, 264, 265; D21/742, 733, 751, 759

(56) References Cited

U.S. PATENT DOCUMENTS

| | | | | | |
|---|---|---|---|---|---|
| 2,723,125 | A | | 11/1955 | Comee | |
| 3,194,564 | A | | 7/1965 | Swan | |
| 3,198,525 | A | | 8/1965 | Smith | |
| 3,262,705 | A | * | 7/1966 | Nunziato | 473/238 |
| 3,273,892 | A | * | 9/1966 | Nolting | 473/238 |
| 3,273,893 | A | * | 9/1966 | Duncan | 473/238 |
| 3,298,693 | A | | 1/1967 | Eisenberg | |
| 3,384,376 | A | | 5/1968 | Greenlee | |
| 3,495,834 | A | * | 2/1970 | Tanczos | 473/238 |
| 3,758,117 | A | * | 9/1973 | Harrison | 473/231 |
| 3,844,569 | A | | 10/1974 | Swanson | |
| 4,002,343 | A | | 1/1977 | Eckert | |
| 4,174,838 | A | | 11/1979 | Paschetto | |
| 4,291,883 | A | * | 9/1981 | Smart et al. | 473/244 |
| 4,647,045 | A | | 3/1987 | Bilyeu | |
| 4,720,109 | A | | 1/1988 | Kryter | |
| 4,789,158 | A | | 12/1988 | Chiesa | |
| 4,921,660 | A | | 5/1990 | Kryter | |
| 4,949,971 | A | | 8/1990 | Thornton | |
| 4,953,867 | A | | 9/1990 | Rigsby | |
| 5,029,868 | A | | 7/1991 | Cloud | |
| 5,135,229 | A | | 8/1992 | Archer | |
| 5,143,376 | A | * | 9/1992 | Johnson | 473/228 |
| 5,351,961 | A | | 10/1994 | Eulau | |
| 5,527,039 | A | | 6/1996 | Levesque | |
| 5,551,695 | A | | 9/1996 | Wolk | |
| 5,605,509 | A | | 2/1997 | Gray | |
| 5,716,286 | A | * | 2/1998 | Swan | 473/175 |
| 5,842,932 | A | | 12/1998 | Goddard | |
| 5,997,409 | A | | 12/1999 | Mattson | |

* cited by examiner

*Primary Examiner*—Sebastiano Passaniti
(74) *Attorney, Agent, or Firm*—Van Dyke, Gardner, Linn & Burkhart, LLP

(57) ABSTRACT

An alignment device for aligning a stroke path of a golf club comprises a body portion and a pair of spaced apart guide members. The body portion includes a mounting portion which is configured to mount to a shaft portion of a golf club. The body portion is positioned along and generally above a club head of the golf club when the mounting portion is mounted to the shaft portion. The guide members are spaced apart and extend from the body portion and extend generally perpendicularly to the face of the golf club head when the mounting portion is mounted to the shaft portion of the golf club. The spaced apart guide members facilitate alignment of the stroke path of the golf club without interfering with the line of sight from the golfer to the golf club head and/or the golf ball during the golf swing or practice stroke.

22 Claims, 2 Drawing Sheets

GOLF CLUB ALIGNMENT AID

FIELD OF THE INVENTION

The present invention relates generally to golf club accessories and, more particularly, to a sight or alignment aid for aligning a stroke path or swing path of a golf club.

BACKGROUND OF THE INVENTION

Golf club sights have been developed for aiding a golfer in aligning the stroke path of a golf club, such as a putter or the like. Many proposed golf-training or sighting or aligning devices are positioned generally above the club head and provide a single pointer or indicator, which points generally in the direction of the desired stroke path of the golf club. The indicator or pointer is positioned generally above and in alignment with the desired location of the clubface for impacting the golf ball.

Other golf sighting devices have been proposed which require modification of the club head to affix the golf sighting devices thereto. Such sighting devices thus may not be universally applicable to any golf club. Also, some sighting devices are designed to fit generally around the club head and may even be positioned beneath the club head. Because there are a wide variety of shapes and designs for putters and other golf club heads, such devices may not be suitable for use with many putters or other golf clubs, and may further interfere with the stroke path of the club head since the sighting device may contact the ground during the stroke or swing of the golf club.

Therefore, there is a need in the art for an improved golf alignment aid or device which overcomes the shortcomings of the prior art.

SUMMARY OF THE INVENTION

The present invention is intended to provide a golf club alignment aid which may be easily removably attached to almost any golf club or putter and which facilitates easy alignment of the stroke path of the club by the golfer, without interfering with the golfer's line of sight to the golf ball. The golf club alignment aid of the present invention provides a pair of spaced apart guide members extending from a body portion, which may be snapped or otherwise mounted or removably mounted to a shaft portion of a golf club. The present invention may be formed or molded of a plastic material and may be lightweight so that the golf club alignment aid does not adversely affect the feel of the golf club during the stroke or practice swing by the golfer.

According to an aspect of the present invention, an alignment device for aligning a stroke path of a golf club comprises a body portion and a pair of spaced apart guide members. The body portion includes a mounting portion which is configured to mount to a shaft portion of a golf club. The body portion extends generally above a club head of the golf club when the mounting portion is mounted to the shaft portion. The guide members extend from the body portion and are oriented generally perpendicularly to the face of the golf club head when the mounting portion is mounted to the shaft portion of the golf club.

The spaced apart guide members provide for alignment of the stroke path of the golf club without interfering with the line of sight of the golfer to the golf ball. One of the guide members may be positioned generally at or near the end of the body portion near or at the mounting portion, while the other guide member may be positioned generally at or near the opposite end of the body portion from the mounting portion. The body portion may be adapted to contact a toe of the club head with the opposite end to align the body portion above and along the face of the club head when the mounting portion is mounted to the shaft portion of the golf club.

The mounting portion may comprise a flexible snap type clasp which flexes to receive the shaft portion of the golf club to removably mount the alignment device to the shaft portion of the golf club. The body portion, guide members and mounting portion or snap clasp may be unitarily or integrally molded or otherwise formed of a plastic or polymeric material or other suitable material or materials.

Therefore, the present invention provides for a golf club alignment device or aid which may be easily attached to and removed from a shaft portion of a golf club. The alignment device thus may be mounted to almost any design of golf club, regardless of the shape or design of the club head. The alignment device of the present invention provides for a pair of spaced apart guide members or alignment aids extending from generally opposite ends of a body portion, such that the guide members do not interfere with the line of sight from the golfer to the golf ball. Also, the alignment device of the present invention may comprise a plastic material or other suitable material to provide a lightweight golf club aid which does not adversely affect the feel of the golf club during the stroke or practice swing by the golfer. By integrally molding or unitarily molding the alignment device, the present invention may provide an alignment device which is lightweight, easy to manufacture, and easy to removably mount to a shaft portion of almost any type of putter or golf club.

These and other objects, advantages, purposes and features of the present invention will become more apparent upon review of the following specification in conjunction with the drawings.

DESCRIPTION OF THE PREFERRED EMBODIMENTS

Figure 1:
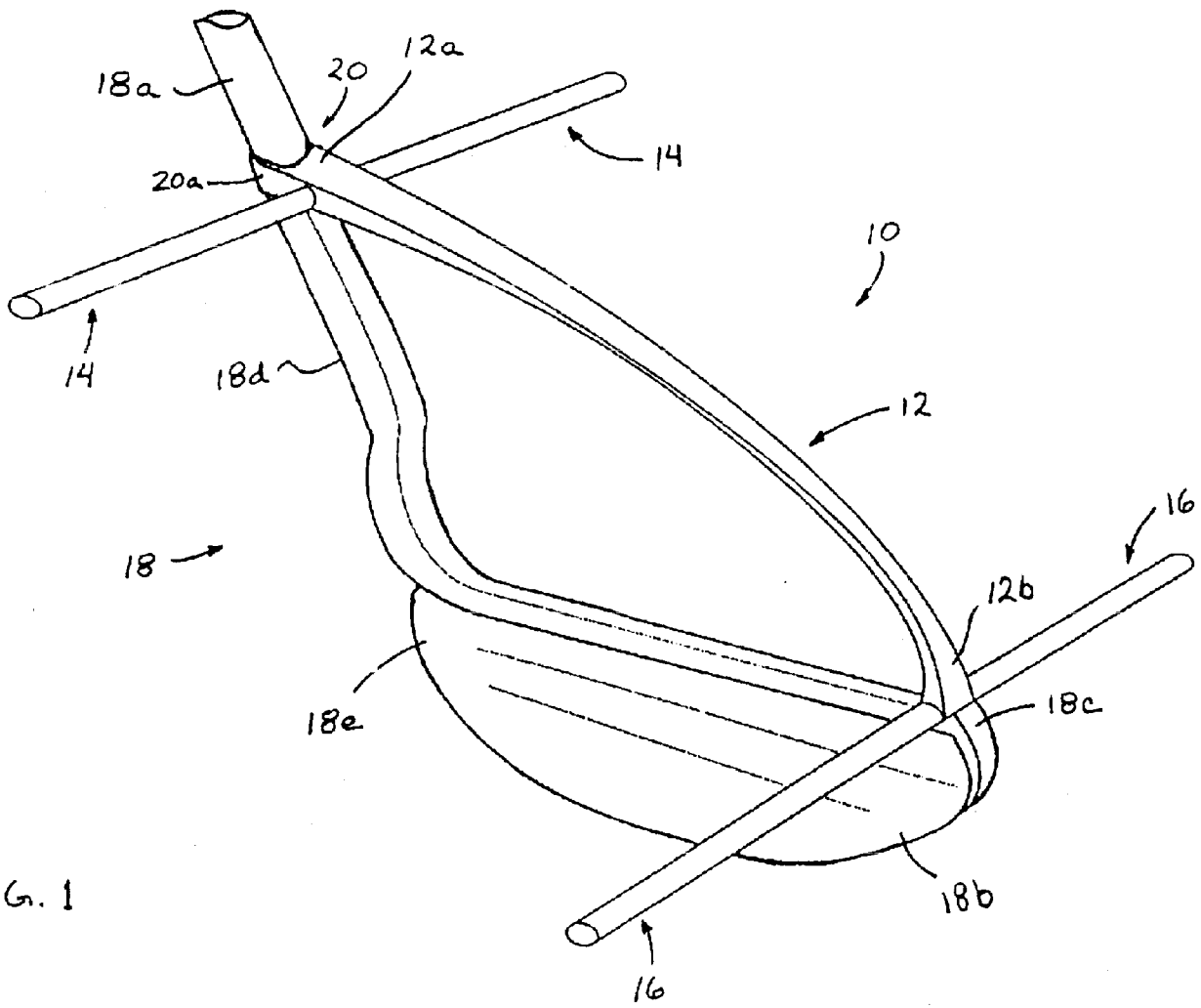
FIG. 1 is a perspective view of a golf club alignment device in accordance with the present invention, as mounted to a shaft of a golf club.
Figure 2:
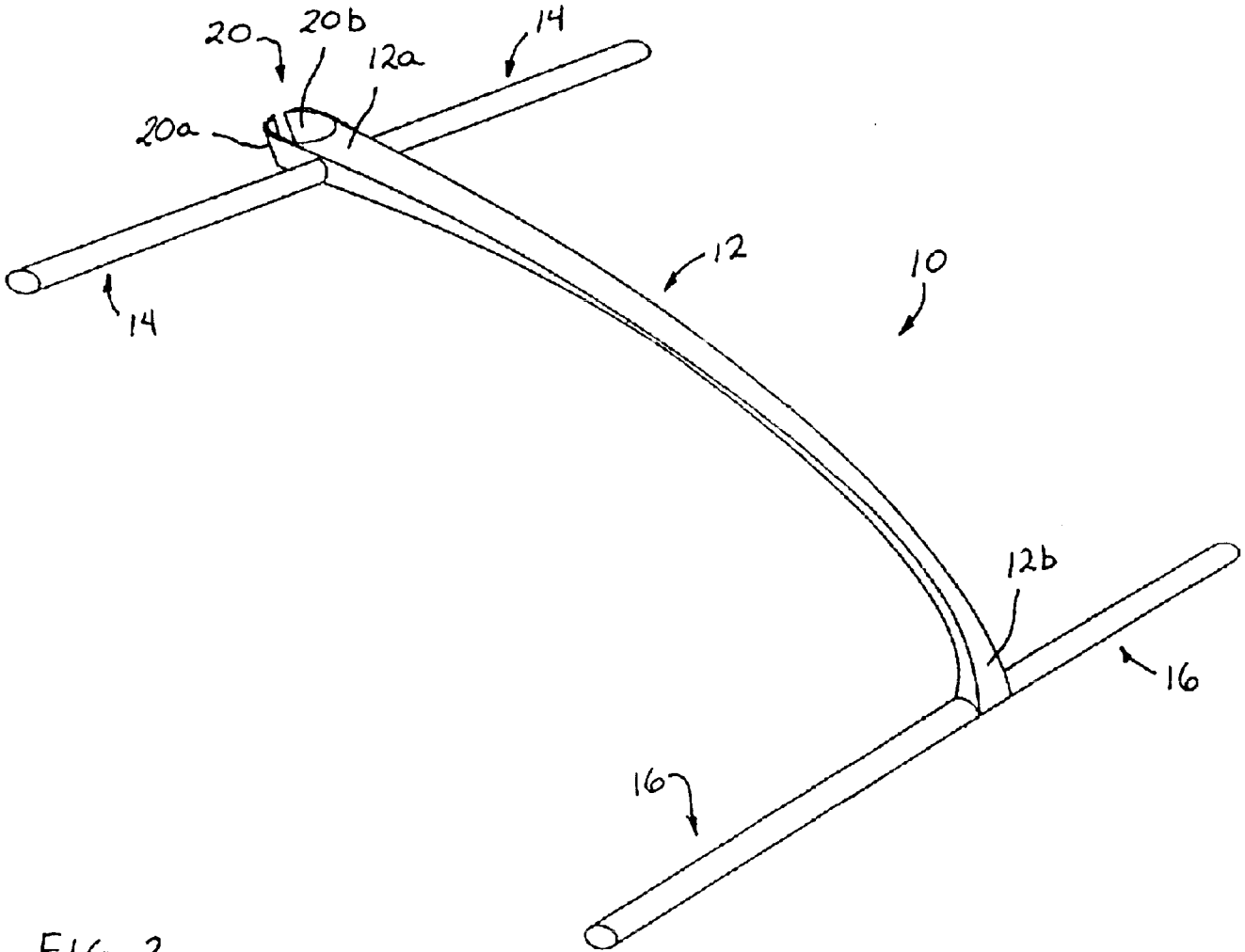
FIG. 2 is another perspective view of the golf club alignment device of FIG. 1, as removed from a golf club.

Referring now to the drawings and the illustrative embodiments depicted therein, a golf club alignment device 10 comprises a body portion 12 and a pair of spaced apart alignment members or guides 14, 16 extending from body portion 12 (FIGS. 1 and 2). Alignment device 10 may be snapped to or otherwise removably mounted to a golf club 18, such as to a shaft 18*a* of golf club 18, as shown in FIG. 1. When mounted to shaft 18*a* of golf club 18, alignment device 10 facilitates alignment of a stroke path of golf club 18 with a target or desired direction, as discussed below.

In the illustrated embodiment, body portion 12 of alignment device 10 comprises a curved member or arched spine which includes a mounting portion 20 at one end 12*a* for mounting the alignment device to the shaft 18*a* of golf club 18. Body portion 12 may be configured such that when the mounting portion 20 is mounted to or secured at the shaft 18*a* of golf club 18, the opposite end 12*b* of body portion 12 extends outward and downward from mounting portion 20 and may contact an upper surface of the toe 18*c* of golf club head 18*b*. The body portion 12 is thus positioned generally above the golf club head 18*b* and generally parallel to the face of the golf club head when mounting portion 20 is mounted to shaft 18*a*.

Mounting portion 20 of body portion 12 preferably comprises a pair of flexible curved clasps or members 20*a* which define a generally circular passageway 20*b* (FIG. 2) through mounting portion 20 for receiving shaft 18*a* of golf club 18. The flexible clasps 20*a* flex apart to fit around the shaft and clasp around the shaft to secure the body portion 12 to the shaft of golf club. Thus, alignment device 10 may be quickly and easily mounted to and removed from the shaft of almost any golf club by pressing the mounting portion toward the shaft and pulling the mounting portion away from the shaft, respectively. Although shown and described as being mountable to the shaft of a golf club, the term "shaft" or "shaft portion" as used herein is meant to include the shaft of the golf club and a shaft extension or head mounting extension 18*d* of the golf club head which may extend upward from the club head, such as from the heel portion 18*e* of the club head, for connecting the golf club head to the typically metal or graphite shaft of the golf club.

Alignment guides 14, 16 are oriented generally parallel to one another and may extend from opposite ends of body portion 12. In the illustrated embodiment, alignment guide 14 extends in both directions from end 12*a* of body portion 12 and near mounting portion 20, while alignment guide 16 extends in both directions from end 12*b* of body portion 12. As can be seen in FIG. 1, when alignment device 12 is mounted to the shaft 18*a* or the head mounting extension 18*d* of golf club 18, with end 12*b* of body portion 12 at or near or contacting the toe 18*c* of the golf club head 18*b*, alignment guides 14, 16 extend generally perpendicularly to the face of the club head. Alignment guide 16 is thus positioned at the toe region of the golf club head, while alignment guide 14 is positioned at a shaft area of the golf club. The spaced apart arrangement of the two alignment guides 14, 16 provides for uninterrupted viewing of the golf ball and golf club face by the golfer when aligning the stroke path of the golf club. Also, the narrow profile of body portion 12 further limits or substantially precludes interference with the view of the golfer, since the body portion is positioned generally over the club head and, thus, does not interfere with the golfer's view of the golf ball.

In the illustrated embodiment, the alignment guides 14, 16 are shown as generally cylindrical extensions from body portion 12. However, other cross sectional shapes may be implemented for the alignment guides, without affecting the scope of the present invention. Also, although shown as extending in both directions from body portion 12, alignment guides 14, 16 may extend in one direction to extend over the forward face of the golf club head for aligning the stroke path of the golf club. Preferably, alignment guides 14, 16 extend in both directions from body portion 12, such that the alignment device 10 may be equally suitable for use on left-handed golf clubs and right-handed golf clubs.

Optionally, the golf club alignment device of the present invention may be unitarily or integrally molded of a plastic or polymeric material. The plastic material may be selected so as to provide a lightweight and durable alignment device. For example, the alignment device may comprise a substantially rigid and strong polymeric material, such as a thermoplastic material, such as nylon or the like, or any other suitable polymeric or plastic material or materials, without affecting the scope of the present invention. The molded plastic golf club device provides a lightweight yet durable alignment device which may have a minimal or negligible effect on the feel of the golf club to the golfer when the golfer is swinging the golf club or practicing the golf club stroke or putting. Also, the flexible plastic clasp members 20*a* of mounting portion 20 provide for easy attachment to and removal from the shaft of almost any golf club. Clearly, however, the golf club alignment device of the present invention may comprise other materials, such as metallic materials or the like, and may be formed from separate components, without affecting the scope of the present invention.

Therefore, the present invention provides a golf club alignment device which may be easily attached to or removed from a shaft or shaft portion of almost any golf club. The alignment device provides a pair of alignment guides to assist in aligning the stroke path of the golf club, while substantially avoiding any interference with the view of the club face and golf ball by the golfer. The alignment device also provides a generally universal alignment device, which may mount to the shaft or shaft portion of almost any golf club or putter and which may be equally suitable for right-handed and left-handed golf clubs. Because the alignment device of the present invention may be molded of a plastic material, the alignment device may provide a lightweight, durable and low cost alignment device which may be applicable to almost any golf club design.

Changes and modifications in the specifically described embodiments may be carried out without departing from the principles of the present invention, which is intended to be limited only by the scope of the appended claims as interpreted according to the principles of patent law.

What is claimed is:

1. An alignment device in combination with a golf club, said alignment device being mountable to a golf club for aligning a stroke path of the golf club, the golf club having a shaft portion and a club head at an end of the shaft portion, said alignment device comprising:

a body portion;

a mounting portion at one end of said body portion, said mounting portion being configured to mount to the shaft portion of the golf club, said body portion extending generally over the club head when said mounting portion is mounted to the shaft portion; and a pair of guide members extending from said body portion, said guide members being spaced apart from one another along said body portion and being generally parallel to one another, said guide members being oriented generally perpendicular to the face of the club head when said mounting portion is mounted to the shaft portion of the golf club.

2. The alignment device of claim 1, wherein said mounting portion is configured to removably mount to the shaft portion of the club.

3. The alignment device of claim 1, wherein said mounting portion comprises a flexible clasp which flexes to receive the shaft portion within said clasp to retain said alignment device on the shaft portion.

4. The alignment device of claim 3, wherein said mounting portion comprises a plastic material.

5. The alignment device of claim 4, wherein said body portion and said mounting portion are integrally molded of said plastic material.

6. The alignment device of claim 5, wherein said body portion, said mounting portion and said guide members are integrally molded of said plastic material.

7. The alignment device of claim 1, wherein one of said members is positioned generally at said mounting portion and the other of said guide members is positioned generally at an end of said body portion opposite from said mounting portion.

8. The alignment device of claim 1, wherein each of said guide members extends in opposite directions from said body portion.

9. An alignment device in combination with a golf club, said alignment device being mountable to a golf club for aligning a stroke path of the golf club, the golf club having a shaft portion and a club head at an end of the shaft portion, said aliment device comprising:

a body portion;

a mounting portion at one end of said body portion, said mounting portion being configured to mount to the shaft portion of the golf club, said body portion extending generally over the club head when said mounting portion is mounted to the shaft portion; and a pair of guide members extending from said body portion, said guide members being spaced apart from one another and being generally parallel to one another, said guide members being oriented generally perpendicular to the face of the club head when said mounting portion is mounted to the shaft portion of the golf club, wherein said body portion is adapted to contact a toe of the club head at an end of said body portion opposite to said mounting portion to generally align said body portion along the club head when said mounting portion is mounted to the shaft portion of the golf club.

10. An alignment device in combination with a golf club, said alignment device being mountable to a golf club for aligning a stroke path of the golf club, the golf club having a shaft portion and a club head at an end of the shaft portion, said alignment device comprising:

a body portion;

a mounting portion at one end of said body portion, said mounting portion being configured to mount to the shaft portion of the golf club, said body portion extending generally over the club head when said mounting portion is mounted to the shaft portion; and a pair of guide members extending from said body portion, said guide members being spaced apart from one another and being generally parallel to one another, said guide members being oriented generally perpendicular to the face of the club head when said mounting portion is mounted to the shaft portion of the golf club, wherein said body portion comprises a curved member which curves downwardly from said mounting portion and is adapted to contact a toe of the club head at an end of said body portion opposite to said mounting portion when said mounting portion is mounted to the shaft portion of the golf club.

11. An alignment device in combination with a golf club, said alignment device being mountable to a golf club for aligning a stroke path of the golf club, the golf club having a shaft portion and a club head at an end of the shaft portion, said alignment device comprising:

a body portion having a mounting portion at a first end of said body portion, said mounting portion being configured to removably mount to the shaft portion of the golf club, said body portion extending generally over the club head when said mounting portion is mounted to the shaft portion of the golf club;

a first guide member positioned generally at said first end of said body portion and extending from said body portion; and a second guide member positioned generally at a second end of said body portion and extending from said body portion, said second end being generally opposite said first end, said first and second guide members being spaced apart from one another along said body portion, said first and second guide members extending generally perpendicular to the face of the club head when said mounting portion is mounted to the shaft portion of the golf club.

12. The alignment device of claim 11, wherein said mounting portion comprises a flexible clasp which flexes to receive the shaft portion within said clasp to retain said alignment device on the shaft portion of the golf club.

13. The alignment device of claim 12, wherein said mounting portion comprises a plastic material.

14. The alignment device of claim 13, wherein said body portion and said mounting portion are integrally molded of said plastic material.

15. The alignment device of claim 11, wherein each of said first and second guide members extends in opposite directions from said body portion.

16. An alignment device in combination with a golf club, said alignment device being mountable to a golf club for aligning a stroke path of the golf club, the golf club having a shaft portion and a club head at an end of the shaft portion, said alignment device comprising:

a body portion having a mounting portion at a first end of said body portion, said mounting portion being configured to removably mount to the shaft portion of the golf club, said body portion extending generally over the club head when said mounting portion is mounted to the shaft portion of the golf club;

a first guide member positioned generally at said first end of said body portion and extending from said body portion; and a second guide member positioned generally at a second end of said body portion and extending from said body portion, said second end being generally opposite said first end, said first and second guide members extending generally perpendicular to the face of the club head when said mounting portion is mounted to the shaft portion of the golf club, wherein said body portion is configured to contact a toe of the club head at an end of said body portion opposite to said mounting portion to generally align said body portion along the club head when said mounting portion is mounted to the shaft portion of the golf club.

17. An alignment device in combination with a golf club, said alignment device being mountable to a golf club for aligning a stroke path of the golf club, the golf club having a shaft portion and a club head at an end of the shaft portion, said alignment device comprising:

a plastic body portion having a flexible clasp at a first end of said body portion, said flexible clasp being configured to receive the shaft portion of the golf club, said body portion extending generally over the club head toward a toe of the club head when said flexible clasp receives the shaft portion of the golf club;

a first guide member positioned generally at said first end of said body portion and extending from said body portion; and a second guide member positioned generally at a second end of said body portion and extending from said body portion, said second end being generally opposite said first end, said first and second guide members being spaced apart from one another alone said body portion, said first and second guide members extending generally perpendicular to the face of the club head when said flexible clasp receives the shaft portion of the golf club.

18. The alignment device of claim 17, wherein said body portion comprises a curved member which curves downwardly from said flexible clasp and is adapted to contact the toe of the club head at said second end when said flexible clasp receives the shaft portion of the golf club.

19. The alignment device of claim 17, wherein each of said first and second guide members extends in opposite directions from said body portion.

20. The alignment device of claim 17, wherein said alignment device comprises a unitarily molded plastic alignment device.

21. An alignment device in combination with a golf club, said alignment device being mountable to a golf club for aligning a stroke path of the golf club, the golf club having a shaft portion and a club head at an end of the shaft portion, said alignment device comprising:

a plastic body portion having a flexible clasp at a first end of said body portion, said flexible clasp being configured to receive the shaft portion of the golf club, said body portion extending generally over the club head toward a toe of the club head when said flexible clasp receives the shaft portion of the golf club;

a first guide member positioned generally at said first end of said body portion and extending from said body portion; and a second guide member positioned generally at a second end of said body portion and extending from said body portion, said second end being generally opposite said first end, said first and second guide members extending generally perpendicular to the face of the club head when said flexible clasp receives the shaft portion of the golf club, wherein said body portion is configured to contact a toe of the club head at said second end to generally align said body portion along the club head when said flexible clasp receives the shaft portion of the golf club.

22. The alignment device of claim 21, wherein each of said first and second guide members extends in opposite directions from said body portion.

* * * * *

UNITED STATES PATENT AND TRADEMARK OFFICE

CERTIFICATE OF CORRECTION

PATENT NO. : 6,872,149 B1
APPLICATION NO. : 10/361340
DATED : March 29, 2005
INVENTOR(S) : Scott Devon It is certified that error appears in the above-identified patent and that said Letters Patent is hereby corrected as shown below:

On the Title Page Item (73) Assignee:
"Catamount, Golf, L.L.C." should be --Catamount Golf, L.L.C.--.

Column 5:
Line 8, Claim 9, "aliment" should be --alignment--.

Column 6:
Line 62, Claim 17, "alone" should be --along--.

Signed and Sealed this

First Day of April, 2008

JON W. DUDAS
*Director of the United States Patent and Trademark Office*